US006105312A

United States Patent [19]

Lucas

[11] Patent Number: 6,105,312

[45] Date of Patent: Aug. 22, 2000

[54] SECTIONAL GATE

[75] Inventor: Bernd Lucas, Lingen, Germany

[73] Assignee: Belu Tec GmbH, Lingen, Germany

[21] Appl. No.: 09/180,235

[22] PCT Filed: May 2, 1997

[86] PCT No.: PCT/EP97/02242

§ 371 Date: Mar. 26, 1999

§ 102(e) Date: Mar. 26, 1999

[87] PCT Pub. No.: WO97/42387

PCT Pub. Date: Nov. 13, 1997

[30] Foreign Application Priority Data

May 2, 1996 [DE] Germany ..... 296 07 802 U

[51] Int. Cl.[7] ..... E05F 11/00; E05F 15/00; E05F 13/00

[52] U.S. Cl. ..... 49/200; 49/199; 160/191

[58] Field of Search ..... 49/199, 200, 197, 49/332, 352; 160/190, 191, 188, 193

[56] References Cited

U.S. PATENT DOCUMENTS

| | | | |
|---|---|---|---|
| 1,747,206 | 2/1930 | Wilson . | |
| 1,948,770 | 2/1934 | Rowe . | |
| 2,029,201 | 1/1936 | Shaffer . | |
| 2,032,768 | 3/1936 | Rowe . | |
| 2,051,421 | 8/1936 | Richard | 160/191 |
| 2,064,470 | 12/1936 | Heckman | 160/191 X |
| 2,142,562 | 1/1939 | Greegor . | |
| 2,436,006 | 2/1948 | Kaiser . | |
| 2,453,554 | 11/1948 | Thomas . | |
| 2,525,309 | 10/1950 | Norberg . | |
| 3,129,752 | 4/1964 | Whiting | 160/191 X |
| 4,082,133 | 4/1978 | Halopoff | 160/191 |

FOREIGN PATENT DOCUMENTS

| | | |
|---|---|---|
| 2 672 079 | 7/1992 | France . |
| 913 269 | 6/1954 | Germany . |
| 2 228 783 | 1/1974 | Germany . |
| 35 08 957 | 9/1986 | Germany . |
| 40 06 912 | 9/1991 | Germany . |

OTHER PUBLICATIONS

International Search Report, dated Aug. 21, 1997.

International Preliminary Examination Report, dated Aug. 17, 1998.

*Primary Examiner*—Daniel P. Stodola
*Assistant Examiner*—Hugh B. Thompson
*Attorney, Agent, or Firm*—Vickers, Daniels & Young

[57] ABSTRACT

A sectional gate assembly to move a sectional gate between an open position and a closed position by an upper and lower closing element. The upper closing element is flexibly connected with the lower closing element, and both the upper and lower closing elements each have a first and a second opposite side and one or more guides which are arranged on each of the first and second opposite sides of the closing elements. The sectional gate assembly includes a first and a second single track guide rail. The first and second guide rails each have a vertical section and a horizontal section connected with a curved portion. One or more of the guides on the upper and lower closing elements are adapted to move within the guide rail. A weight-counterbalancer is included in the sectional gate assembly. The weight-counterbalancer has a traction mechanism which engages at a first end on one of the upper and/or lower said closing elements, and at a second end on an energy accumulator which allows the lower closing element to move into the horizontal section of the rail guides. The weight-counterbalancer also includes a deflection roller for the traction mechanism which is arranged beneath the horizontal section of the rail guides so that the weight-counterbalancer exerts, by way of the traction mechanism, a pulling force that acts generally horizontally on the lower closing element in the gate open position. The pulling force acts generally vertically on the lower closing element in the gate closed position. The sectional gate assembly further includes a mechanism to swivel an upper edge of the upper closing element out of alignment with the guide rails in the closed position. The mechanism includes a pivoting lever attached to the upper closing element and has an arrangement to drive the upper closing element from a first position in the gate open position into a second position in the gate closed position and back to the first position.

19 Claims, 9 Drawing Sheets

SECTIONAL GATE

The invention involves a sectional gate.

BACKGROUND OF THE INVENTION

Clear gate openings of buildings, garages and the like are closed up with sectional gates. In the process, it is common that the sectional gate consists of more than two panel-shaped closing elements (sections), which are led in guide rails by means of guide rollers. The guide rails, which are one-piece as a rule, each have a vertical section in which the rollers of the closing elements are in the closed position, a curved portion connected to this, and a horizontal portion after this in which the rollers of the closing elements are moved for the open position. For most of the sectional gates, the vertical sections are located on both sides of the gate opening and, relative to the gate opening, behind the closing elements so the rollers have to be attached on the back side of the closing elements. The horizontal sections are attached under a ceiling or the like of the building to be closed up, and the vertical and horizontal sections are connected with each other by means of the curved portion.

A sectional gate is known from DE 40 06 912 for which the curved portion, which starts on the side next to the guide rail located at the closing elements at the level of the upper border of the clear gate opening, and for which a weight-counterbalancing mechanism is positioned between the guide rail and the gate opening, and the gate drive takes place through a driven deflection roller of the weight-counterbalancing mechanism. Because the curved portion is above the clear gate opening, the rollers of all of the closing elements are in the closed position in the vertical section of the guide rail. Therefore the surrounding building has to have a high head above the gate opening, so these sectional gates can only be used in relatively high buildings.

A sectional gate is known from DE-OS 22 28 783 for which the guide rail is located behind the closing elements with reference to the gate opening, and the guide rails are laterally arranged in the area of the clear opening. The guide rollers located behind the closing elements guide the closing elements into the vertical closed position, in the process of which the uppermost closing element has to be moved out of a slanted position into a vertical position after the complete lowering of the closing elements by means of an adjusting drive unit. In order to make this movement possible, the guide rail has an opening in the curved portion through which the guide roller of the uppermost section can be swiveled out of the guide rail.

The opening in the curved portion has the disadvantage that the guide rollers of the lower sections can escape from the opening during the lowering of the sections, which can lead to the sectional gate being defective or functioning in a faulty way. Because the guide rails are located within the area of the clear gate opening and behind the closing elements, the sectional gate has to close up a larger gate opening than is useful in the open state. When opening the sectional gate, the upper guide roller has to first be moved precisely back into the guide rail before a force can be applied to move the sectional gate into the horizontal section.

DE 35 08 957 discloses a sectional gate with lateral guide rails located behind the closing elements for which the upper end of the upper closing element is connected with a pivoting lever, which swivels the upper closing element into a vertical position at the end of the closing movement after the upper guide roller hits a limit stop, in order to initiate the swiveling movement of the swivel element on the basis of the lowering movement of the sectional gate. The swivel element is connected with a torsion bar spring, which swivels the swivel element back during the opening of the gate, before the uppermost guide roller moves along the guide rails. The swiveling movement of the swivel element takes place around a fixed turning point situated on the upper edge of the upper section, so the gate has to be lifted as a whole in order to move the upper section into the vertical position.

The task of the invention is to create a sectional gate for which a nearly complete utilization of the clear gate opening is possible in a simple way in the open state of the sectional gate, even with a comparably lower height of the door gate head. A further task of the invention is to make a vertical position of the upper section possible in the closed position, without the functional dependability of the sectional gate being limited during the opening or closing movement.

SUMMARY OF THE INVENTION

The task mentioned at the outset is solved with a sectional gate that allows swiveling of an upper edge of the upper closing element out of alignment with the guide rails ensuring closing of the upper portion of the clear gate opening.

An initial, preferred weight-counterbalancing mechanism has a traction mechanism that is known in and of itself, which acts at one end on a closing element, preferably the lower one and—especially preferred—close to the lower end of the lower one, and which can be fastened so as to be stationary on the other end, for example on the ceiling or the housing wall. The traction mechanism is guided over several deflection rollers and a loose wheel, which can be moved against the restoring force of an energy accumulator or counterweight, and an uppermost deflection roller is located close to the upper end of the curved portion beneath the guide rail. Such an arrangement of this type of the traction mechanism and coupling to the closing elements has the advantage that the force having an effect on the traction mechanism through the energy accumulator or the counterweight acts on the sectional gate until this is nearly, or even completely, in the horizontal section. The connection between the weight-counterbalancing mechanism and the closing elements can also be arranged so as to be detachable by means of carriers—in accordance with the second variation of the weight-counterbalancing mechanism.

If the weight-counterbalancing mechanism is located behind the vertical section of the guide rail, the sectional gate is adjacent in the closed position to a demarcation wall surrounding the clear gate opening, so the sectional gate offers advantages, visually and with regard to its sealing effect, vis-a-vis the sectional gates known from the state of the art.

The weight-counterbalancing mechanism, like a chargeable and dischargeable energy accumulator, supports the driving mechanism. It is essential that it is coupled with one of the closing elements in such a way that even the lower closing element can move into the horizontal section balanced out in terms of weight to the fullest extent possible.

In order to optimize the forces acting on the sectional gate through the traction mechanism, one of the deflection rollers is preferably arranged in such a way that the traction mechanism is guided in a manner that is nearly parallel to the vertical rail up to the curved portion. The traction mechanism automatically detaches itself from this deflection roller if the traction mechanism attachment point of the closing element passes this deflection roller in the direction of opening. In the case of the reverse direction of motion, the traction mechanism automatically attaches itself to this deflection roller again.

In order to also do justice to the safety aspects, among others, the weight-counterbalancing mechanism is preferably located so as to be hidden behind a covering, which as an exit opening to the guide rail for the traction mechanism.

It is to be noted that the weight-counterbalancing mechanism in accordance with the invention can also be used for sliding and sectional gates known from the state of the art that do not have a swiveling mechanism for the upper closing element, and it is consequently of independent significance.

In the case of the sectional gate in accordance with the invention, the guide rails are preferably located on the side, outside of the clear gate opening, and the guide mechanisms such as guide rollers are located on the side of the cross-faces opposite the guide rails, i.e. the faces of the closing elements. The adjustment movement of the sectional gate, especially the opening/closing movement of the upper closing element, is brought about manually or by means of a driving mechanism that preferably acts approximately in parallel to the horizontal section of the guide rails and a swiveling mechanism in each case, such as a pivoting lever, which is coupled at one end to the upper guide mechanism of the upper closing element, and on the other end to the upper closing element at a distance from the upper edge of the upper closing element.

In so doing, the swivel pin lies beneath the guide rollers, so the swiveling mechanism swivels downward during the closing of the gate, relative to the sectional plane, and upwards during opening. The swiveling mechanism is—even without the existence of a weight-counterbalancing mechanism or with the use of a weight-counterbalancing mechanism—of independent inventive significance and permits a sweeping of the upper closing element when there is a lowered gate from a swivel position into a closed position and vice versa, and automatically takes effect as a result of the actuation of the gate drive. Being able to mount the sectional gate in accordance with the invention even in the case of a low gate head or low ceilings and being an actuation arrangement that is compact to build and that only offers little interference are achieved by the arrangement in accordance with the invention of the closing elements, guide rails and the swiveling mechanism of the drive mechanism and the weight-counterbalancing mechanism.

The closing elements are moved into the preferable vertical closing position to close up the clear gate opening; in the process, the closing elements are preferably guided laterally in the guide rails by guide rollers and deviated from a horizontal open position into a vertical closed position on the basis of the flexible attachment of neighboring closing elements. The swiveling mechanism, such as the pivoting lever, is supported on the upper closing element, e.g. on the grounds of its attachment at a distance from the upper edge, as long as the upper closing element is in the horizontal section of the guide rail—and, in fact, until all of the closing elements and the lower guide mechanism of the upper closing element are in the vertical rail. The upper closing element is swiveled into its final closing position, or in the case of the opening movement, swiveled back out of this into a tilted position, by means of the driving mechanism in combination with the swiveling mechanism.

As an advantage, the guide rails form a forced guide for the guide mechanism to minimize the required head height. If, in accordance with a preferred design form, the swiveling mechanism can be compulsorily actuated when actuating the gate drive by means of a forced guide mechanism, such as a guide roller pair, guided by at least one of the guide rails, any arbitrary gate drive type, so even lifting while pushing down by hand, is possible in an especially simple and functionally reliable way.

In a preferred design development, a drive mechanism is set up as a motor-driven side rod drive.

In order to simplify the assembly of the sectional gate in accordance with the invention, the horizontal section can be fastened on the curved portion in a detachable way. For the assembly of the sectional gate, the sectional gate can then be delivered lying within the horizontal section and is only moved into the vertical section when it is attached to the walls located on the side of the gate opening, or if no walls exist, if they are assembled supported on the ground in a self-supporting way.

Further advantages and design developments of the invention ensue from the subclaims and are evident from the following description, with reference to the drawing; in this:

DETAILED DESCRIPTION OF THE INVENTION

Figure 1A:
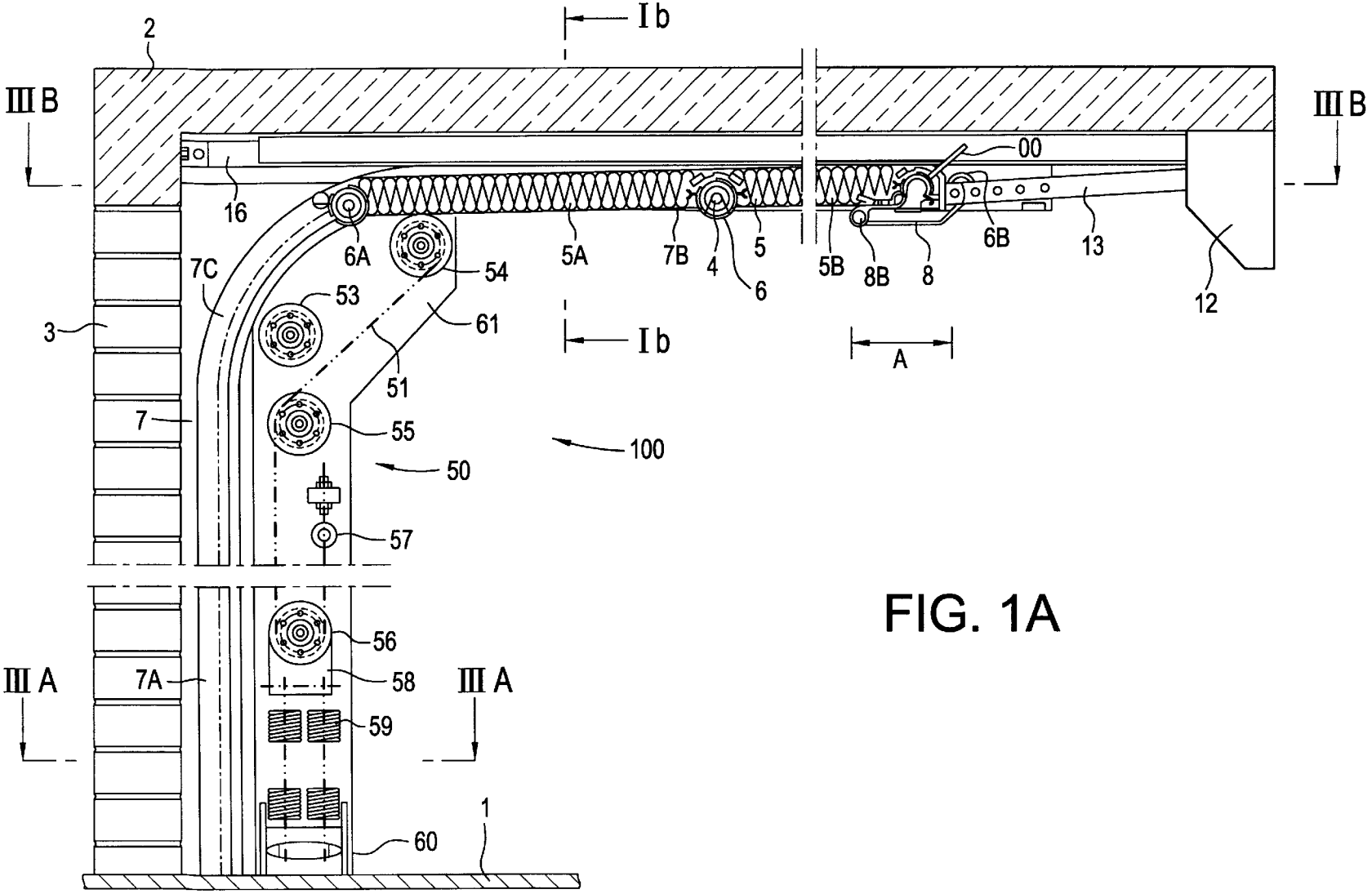
FIG. 1*a* shows a sectional gate in the open position in a vertical view along the Line II—II in FIG. 3B.

A sectional gate designated as a whole with 100, which is attached within a building 2 accessible through a gate opening 3, is shown in detail sections in FIGS. 1*a*/*b*. A vehicle, for example, can be parked in the building. The sectional gate 100 has several closing elements 5; among them, the closing element shown on the left in FIG. 1 forms the lower closing element 5A of the sectional gate and the one shown on the right forms the upper closing element 5B. Closing elements (sections) of sectional gates known from the state of the art can be used as closing elements; design developments such as thermal insulation, design development of support bearings, edge sealing, visual effects etc. will not be looked into more closely.

Neighboring closing elements are flexibly connected with each other; in the design example shown, the guide rollers 6, 6A, 6B make guidance of the closing elements possible in the guide rail designated as a whole with 7, and coaxially-arranged bearings known, for example, from DE-GM 94 03 956.9 make a sweeping of the closing elements 5 among one another possible.

One guide rail 7 each and a weight-counterbalancing mechanism 50 are arranged on both sides of the gate opening 3.

Figure 3A:
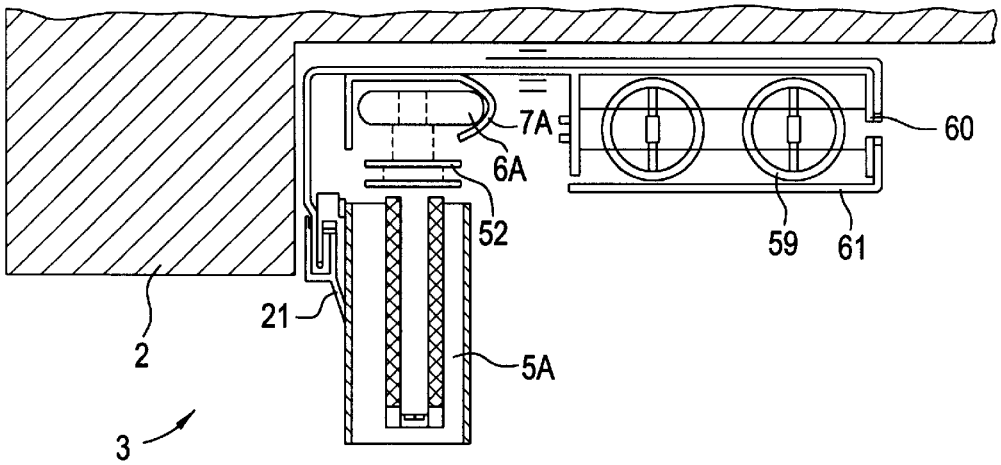
FIGS. 3A/B shows the same sectional gate in a horizontal view along the Line IIIA—IIIA, as well as IIIB—IIIB in FIG. 1 (by detail sections)

The pass-through, i.e. single-track, guide rail 7 has a vertical section 7A, a horizontal section 7B and a curved portion 7C that pass over into each other. It is to be noted that an alignment of these sections which is essentially horizontal or vertical, is understood with the horizontal or vertical section, respectively, because slight deviations of the sections of the guide rails from the precise horizontal or vertical position do not have any influence on the invention conceptions. During the assembly, the vertical section 7A together with the curved portion 7C is laterally attached outside of the clear gate opening 3 (FIGS. 3A/B). The lower guide roller 6A of the lower closing element 5A juts—like all of the other guide rollers—with its face out of the closing element 5, so the closing elements are over one another in the closed position in parallel to the vertical section 7A of the guide rail. The lengthwise extension of the closing elements 5, i.e. in parallel to the ground 1, is somewhat larger than the width of the gate opening 3, so that a complete closing of the gate opening can be achieved without the guide rails jutting into the clear gate opening on the sides.

Figure 2:
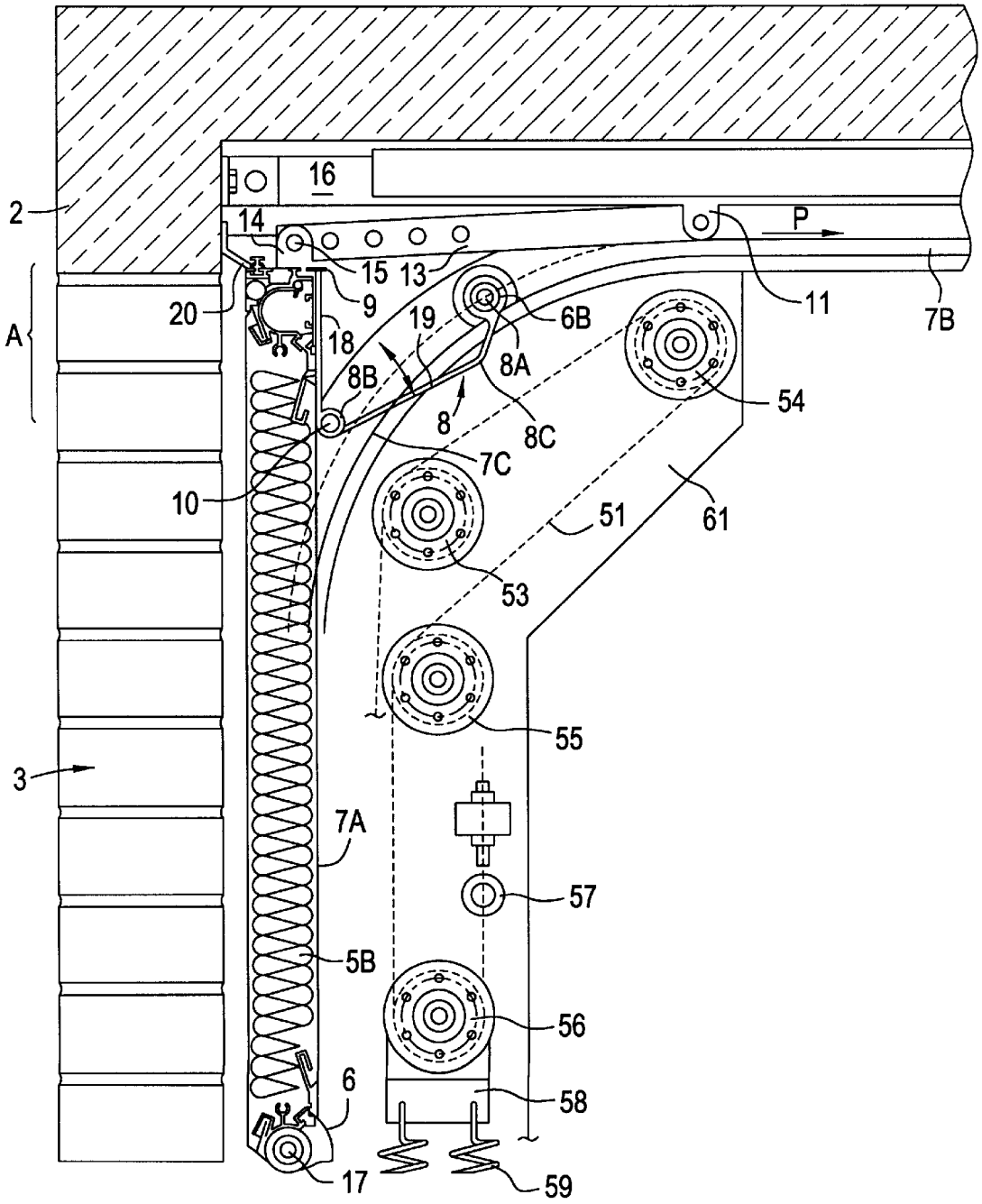
FIG. 2A shows a detail section of the same sectional gate in accordance with the invention in the closed position.
Figure 3B:
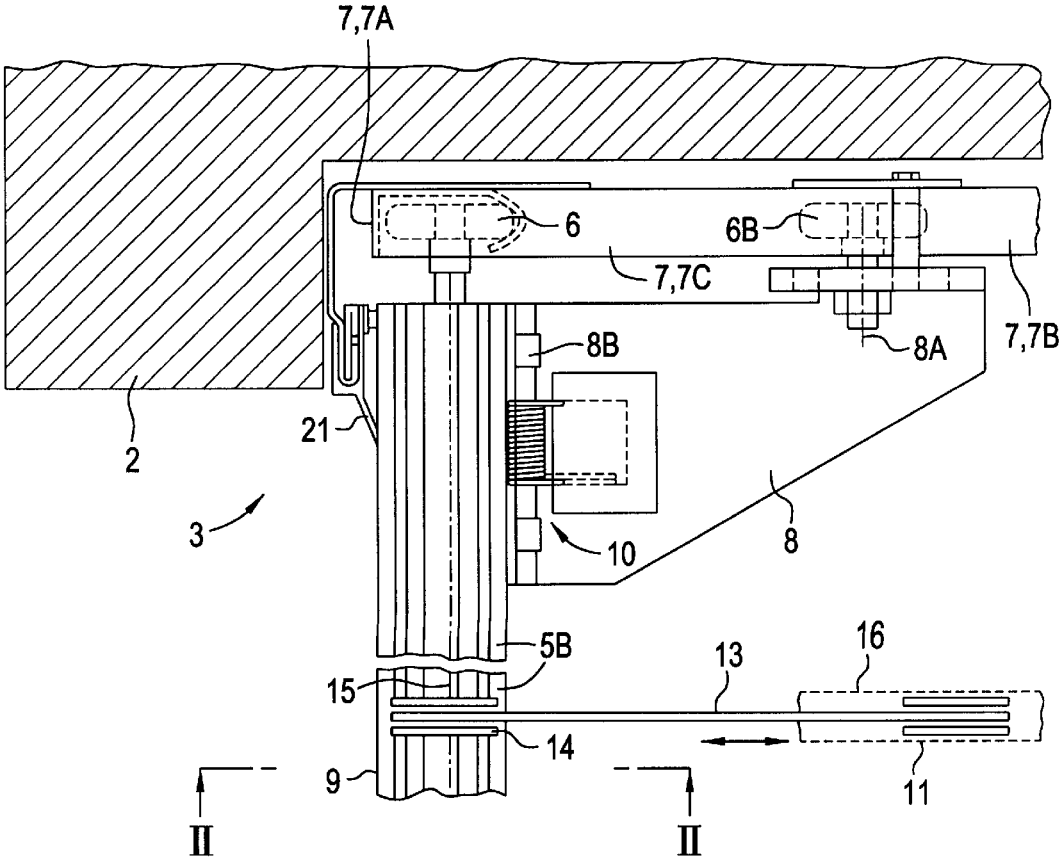

The attachment of a motor-operated driving mechanism and the upper guide roller 6B on the upper closing element 5B is evident from FIGS. 2 and 3B. A pivoting lever 8 is attached so as to be able to swivel at one end, forming a swivel axis 8A, at the upper guide roller 6B. The pivoting lever 8 is attached at the other end, at a distance A from the upper edge 9 of the upper closing element SB by means of a tilting mechanism 10, for example a hinge, forming a second swivel axis 8B. The pivoting lever 8 has a right-angle bend, so that an inner surface 18 of the upper closing element 5B—aligned parallel to the horizontal section—can fit up against the pivoting lever 8 in the open position, as is shown in FIG. 1*a*. A side rod 13 of an electrical drive 12, attached so as to be able to swivel by means of a pin 15, engages in an eyelet 14 at the upper area of the upper closing element 5B—approximately in the middle (FIG. 3B).

The drive element 11 of the side rod 13, guided in a rail 16, moves in the direction of the arrow P to open the sectional gate, so the upper closing element 5B is swiveled away from the gate opening 3 into a tilted position (swivel position) around the articulated axle 17 to the next closing element 5, without the swivel axis 17, and thereby the lower closing elements, having to be lifted. The upper edge 9 of the upper closing element 5B fits up against a support surface 19 of the pivoting lever 8. After the upper closing element 5B has been swiveled out of the vertical position and applied, the upper guide roller 6B is guided from the curved portion 7C of the guide rail into the horizontal section 7B, and the closing elements are lifted. The swiveling of the closing elements around the curve can be influenced by the curvature of the curved portion 7C; in the process, the spacing of the swivel joints of the guidance mechanisms or of the guide rollers 6, as the case may be, determines the swiveling movement of the individual closing elements.

The gate drive is moved contrary to the direction of the arrow P for the complete closing up of the sectional gate, so that the upper closing element 5B is swiveled into the vertical position after the lower closing elements are positioned in the vertical section 7A of the guide rail and the lower closing element 5A, with its lower roller 6A or a closing edge, has set down on the ground 1. A sealing lip 20, extending horizontally, can be attached to the upper closing element, so that the sectional gate closes up the gate opening 3 with a seal all around, using vertical seals 21, in the closed position.

The side rod drive can be an electrical drive active along a horizontal rail 16. A driven, circulating cable, a circulating chain or other suitable drive units can also be used, though.

Figure 5A:
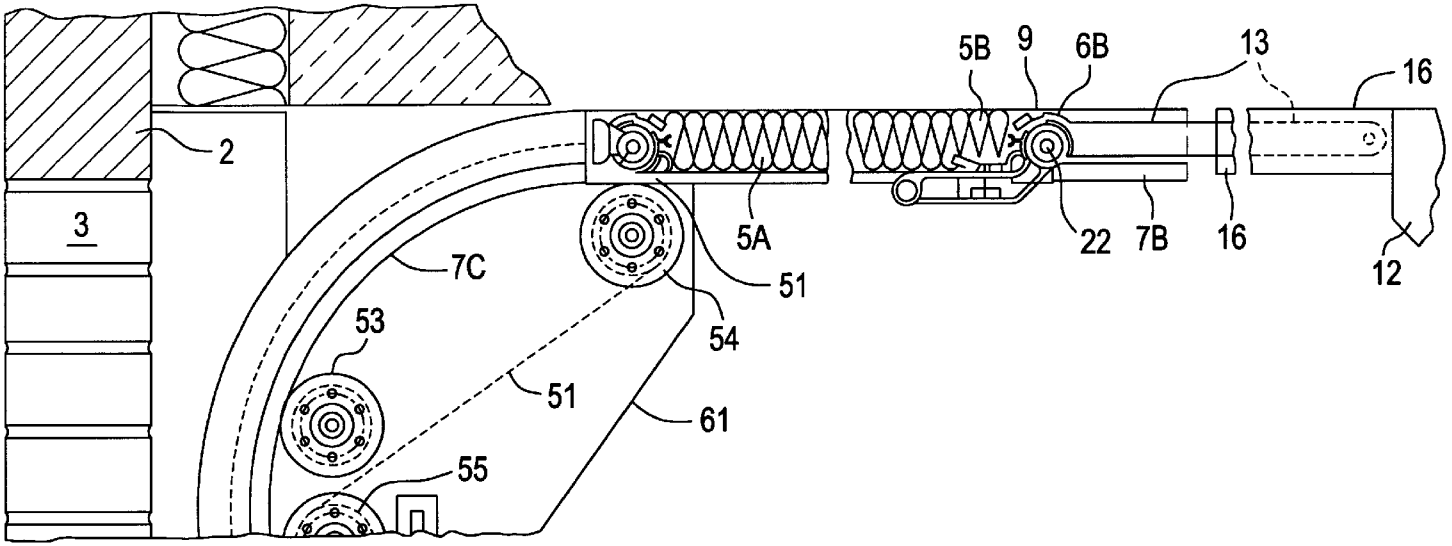
FIGS. 5A/B shows a variation of a sectional gate for the design form according to FIGS. 1 through 3 in an open (FIG. 5A) and a closed (FIG. 5B) position.
Figure 5B:
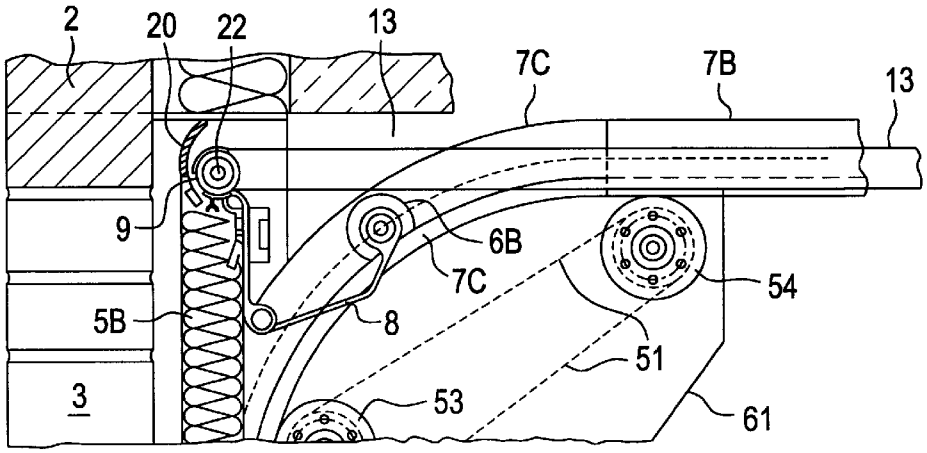

In the case of the design form according to FIGS. 5A/B, an alternative to FIG. 2, the required head height can be reduced even further by the side rod 13 directly engaging at the upper edge 9 of the upper closing element 5B. In this case, a joint or guide roller receptacle that is available, for instance, at the upper edge 9 of the upper closing element 5B is supplied with a drag bearing 22 for a rotatable connection with the side rod 13. If the side rod 13 is equal in length or longer than the clear gate opening, the head height can be reduced to zero if the upper edge 9 of the upper closing element 5B is appropriately designed. This is shown in FIGS. 5A/B.

Figure 1B:
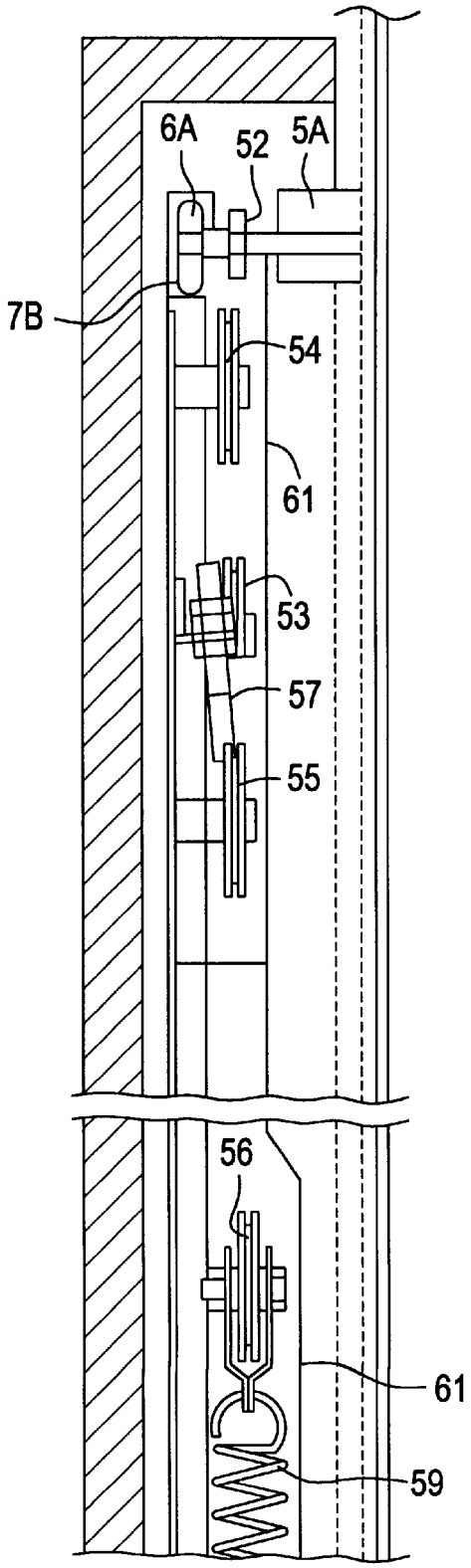
FIG. 1*b* shows a vertical view along the Line Ib—Ib in FIG. 1*a* of the same sectional gate.
Figure 4A:
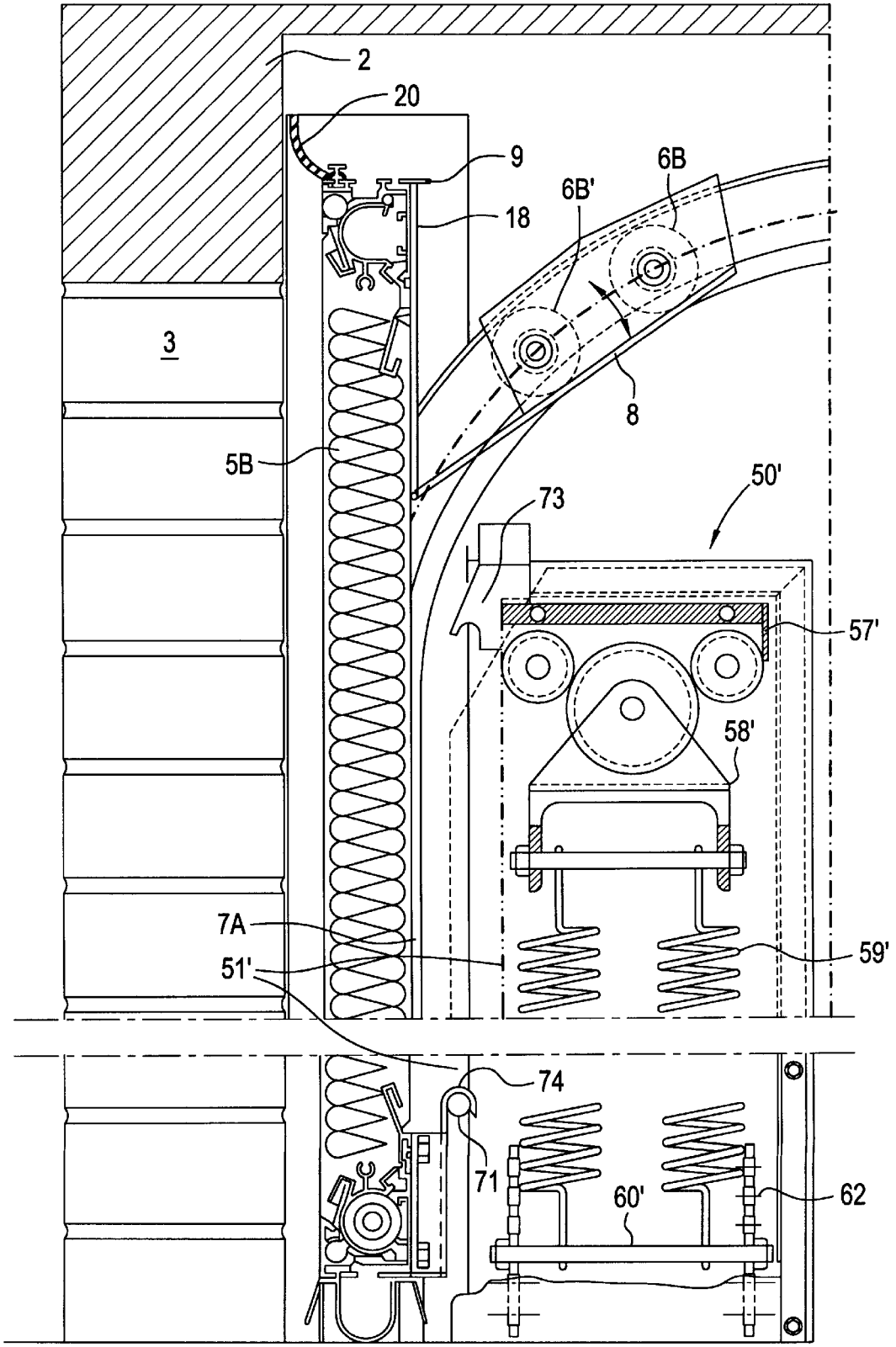
FIGS. 4A/B shows an alternative design form of the weight-counterbalancing mechanism in a closed (FIG. 4A) and an open (FIG. 4B) position.
Figure 4B:
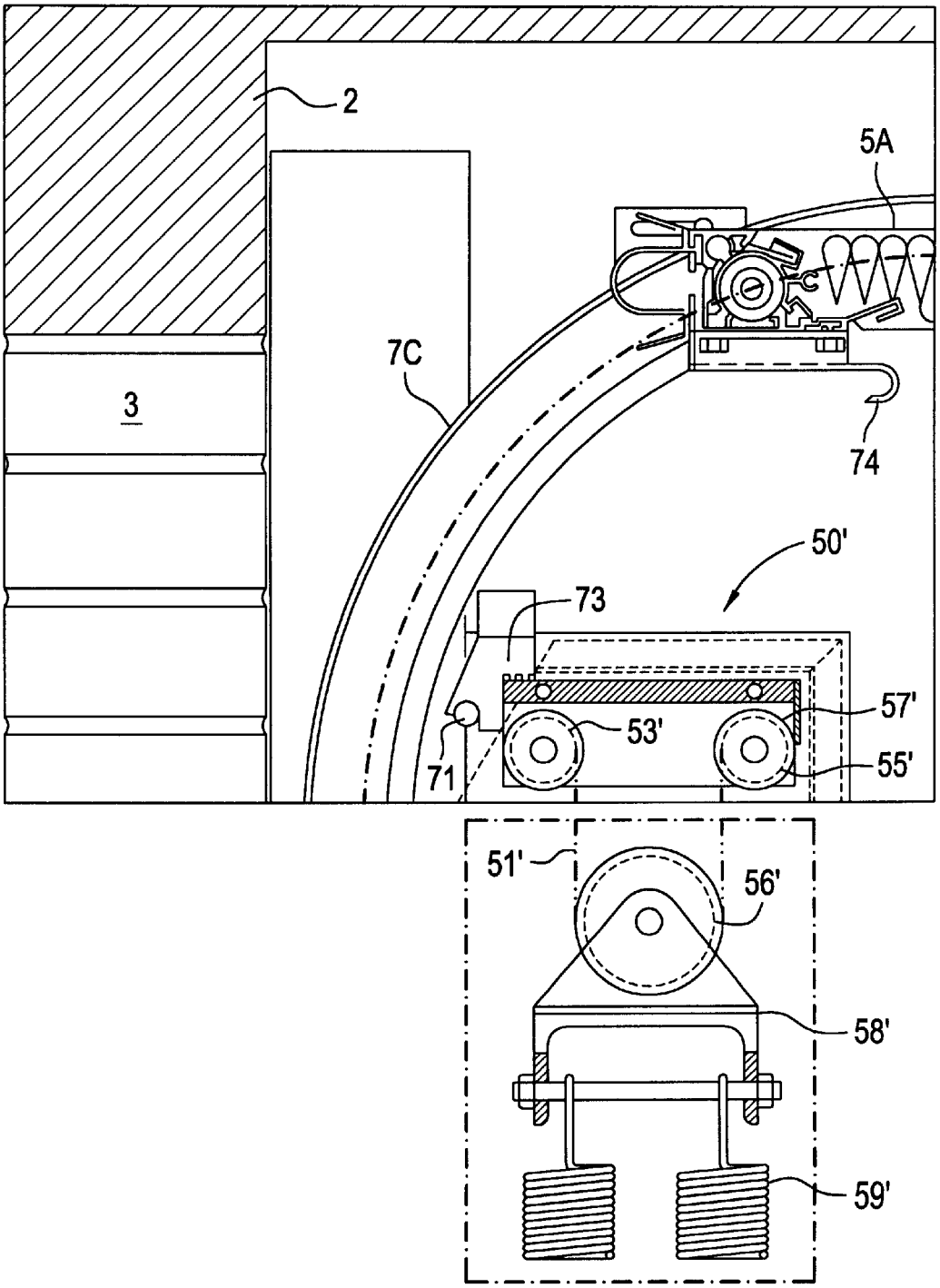

The structure and the function of the weight-counterbalancing mechanism 50; 50' are explained below with reference to FIGS. 1 through 5B: The guide rail 7 preferably runs between the gate opening 3 and the weight-counterbalancing mechanism, which preferably has a cable as a traction mechanism 51; 51'. The traction mechanism is, for example, attached to the lower guide roller 6A of the lower closing element 5A, or through a cable roller 52 (FIG. 3A) or through a different, temporarily active attachment point 74 (FIG. 4A) to one of the closing elements 5. The traction mechanism is preferably guided through deflection rollers 53, 54 and 55 to a loose wheel 56 and around this to a hook 57, for example, by means of which the traction mechanism 51 is fastened within the weight-counterbalancing mechanism 50 (FIG. 2). A support 58, in which the upper ends of two helical springs 59 act, is arranged under the loose wheel 56. The lower ends of the helical springs 59 are wrapped around a fastening pin 60, which is attached on the ground 1 or close to the ground (FIGS. 1 and 4A).

The uppermost deflection roller 54 is close to the transition of the curved portion 7C into the horizontal section 7B and located beneath this (FIGS. 1 and 2; 5A/B), so the traction element 51 is approximately guided up to the beginning of the horizontal section 7B of the guide rail 7. The deflection can also be continued along the horizontal section 7B, so that the traction cable isn't forced to act on the lower end of the sectional gate, in order to be able to be pulled—with the force supported by the weight-counterbalancing mechanism—entirely into a horizontal position.

The deflection roller 53 is located close to the transition of the curved portion 7C into the vertical section 7A, so that the traction element 51 up to the lower guide roller 6A of the lower closing element 5A makes it to the transition between the horizontal section 7B and the curved portion 7C when the closing elements of the sectional gate are moved from the closed position into the open position (and the other way around), as long as they run nearly parallel to the vertical section 7A. The guiding of the traction element 51 by means of the deflection rollers 53 and 54 should, as a first approximation, correspond to the course of the curved portion 7C; further deflection rollers can be arranged to interpolate this course (not shown).

It is beneficial for the assembly of the sectional gate with the weight-counterbalancing mechanism if the curved portion 7C and the horizontal section 7B of the guide rail 7 are connected with each other in a way that is detachable. Because the weight-counterbalancing mechanism acts on the lower closing element 5A outside of the guide rail 7, the weight-counterbalancing mechanism 50 can be delivered in a pre-assembled condition and attached next to the guide rail 7, so that only the traction mechanism 51 has to be attached with its one end to the lower closing element 5A while the closing elements, lying in the horizontal section of the guide rail, are attached to the ceiling.

After the traction mechanism 51 is attached to the lower closing element, a certain amount of initial tension can be set in the helical springs 59 at one of the two attachment points 57 or 52, respectively, or at a track of punched holes 62 (FIG. 4A), so that the weight-counterbalancing mechanism 50 optimally supports the lifting of the closing elements. In addition, the loose wheel 56 moves up under the tension of the springs 59 between two extreme positions (closing) or, as the case may be, down under the release of tension of the springs 59 (opening). It is understood as a matter of course that the loose wheel 56, for the design form shown, can be lifted up without obstacles by at least half of the path of movement of the lower guide roller 6A, so as not to interfere with the functional capability of the weight-counterbalancing mechanism. In the case of the alternative design form of the weight-counterbalancing mechanism 50' in accordance with FIGS. 4A/B, a carrier connection is used in the place of the permanent attachment of the traction element. The traction element 51' is fixed at one end for this, and attached at the other end to a catch piece 71, such as a collet, a pin and the like. The catch piece 71 can be automatically coupled and decoupled from the closing element 5A by means of a holder 73 at a point close to the transition between the curved portion 7C and the vertical section 7A (or it can be close to the transition between the curved portion and the horizontal section by means of deflection rollers as in the case of the first design form). The holder keeps the catch piece 71 in position against the tension of the traction element 59' when the closing elements are in the open position and a carrier 74 and the catch piece 71 are not interlocked with each other.

The carrier 74, e.g. a hook, is attached to the side of the lower closing element turned away from the gate opening 3; the carrier grasps the catch piece 71 in the closing movement (downwards) of the sectional gate and carries it along at least parallel to the vertical section 7C under the tension of the weight-counterbalancing mechanism 50'. An arrangement of a loose wheel between the two deflection rollers 55' and 53', in accordance with the design form according to FIG. 1, can be used for putting tension on the energy-storing springs.

The weight-counterbalancing mechanism is then built in a particularly simple way and extends purely vertically. This solution does justice to the circumstance of the weight becoming smaller and smaller when the gate is opened; especially the fact that a weight-counterbalancing mechanism per se is dispensable during the last path portion of the opening.

This alternative design form shortens and simplifies the assembly of the sectional gate, because the connection between the traction element and the closing elements can be disengaged. An exchange of a defective weight-counterbalancing mechanism can then be done in a particularly problem-free way. The weight-counterbalancing force can likewise be provided by a counterweight that is known in and of itself.

The force that is necessary to move the closing elements from the closed position into the open position can be predetermined through the spring constants and the spring path, or the number of springs as the case may be. Pneumatic springs can also be used as the springs. The vertical position of the energy accumulator (springs) is only preferred; a horizontal alignment or tilted position is likewise possible.

A forced guide is evident from FIGS. 4A/B, which then also moves the swiveling mechanism in accordance with its function at the upper end area of the upper closing element when the gate drive does not engage at the upper end area of the upper closing element; a situation of this type results, for example, when there is a manual actuation through a handle in the lower gate area. The forced guide results in the case of this design example by a guide roller pair 6B, 6B' being attached to a pivoting lever 8 instead of an individual guide roller and the guide roller pair being guided in a forced manner in the guide rail 7.

Figure 6:
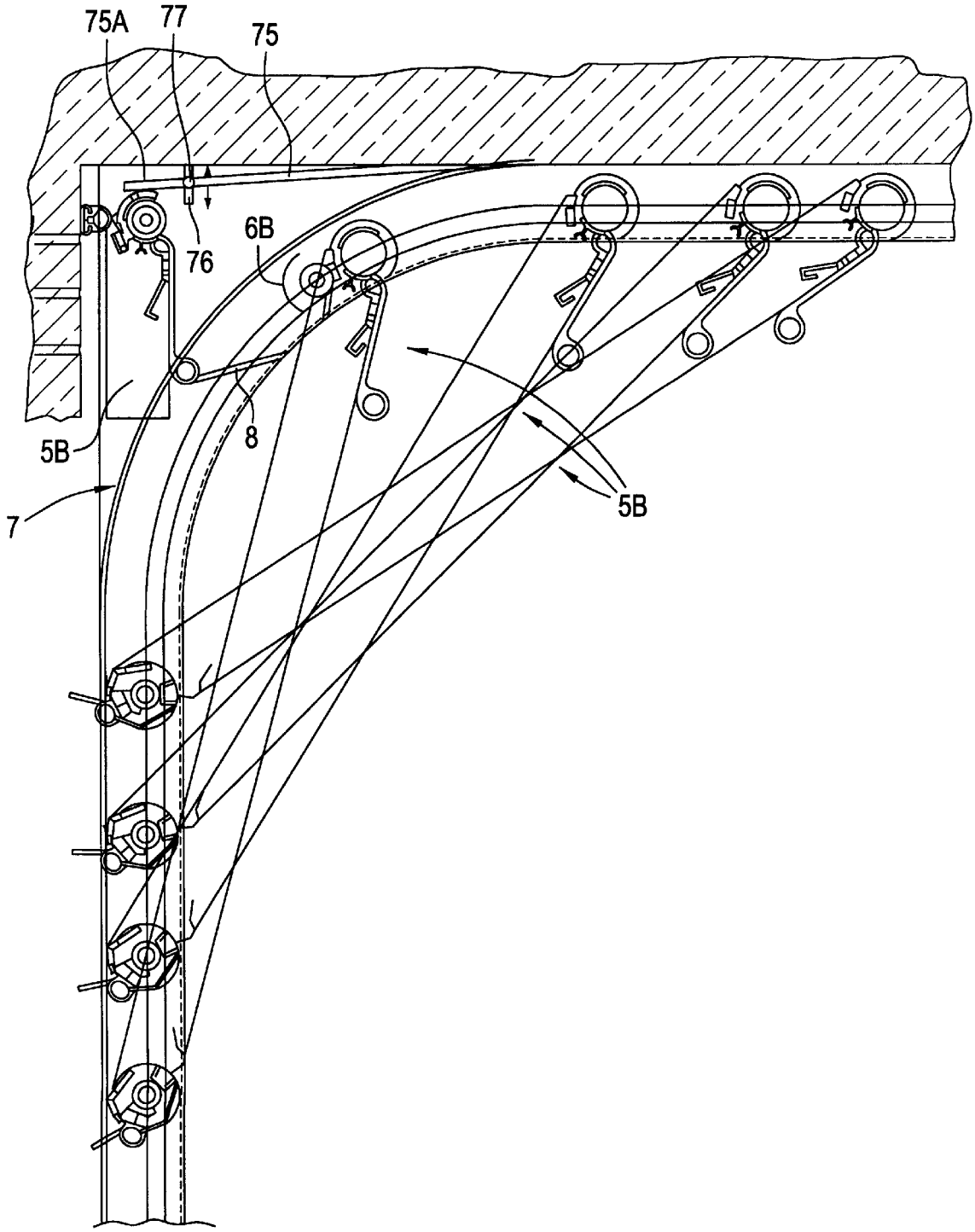
FIG. 6 shows a sequence of the movement of the upper closing element 5B at the beginning of the opening movement of a similar sectional gate as in FIG. 2.

Finally, FIG. 6 shows the upper closing element 5B in various phases of its initial opening path, as well as a hold-down device 75, developed as a metal strip; the upper closing element 5B can support itself at the top against the free end 75A of the hold-down device when the closing element is swiveled into its closed position to prevent an excessive lifting of the closing elements by the weight-counterbalancing mechanism (forced guide). The hold-down device 75 is attached on the end that is on the right in the drawing to the guide rail 7 and can be adjusted in height by means of a slot 76 and a clamping mechanism 77. The hold-down device simultaneously serves as a safety device against being pushed up.

Figure 7:
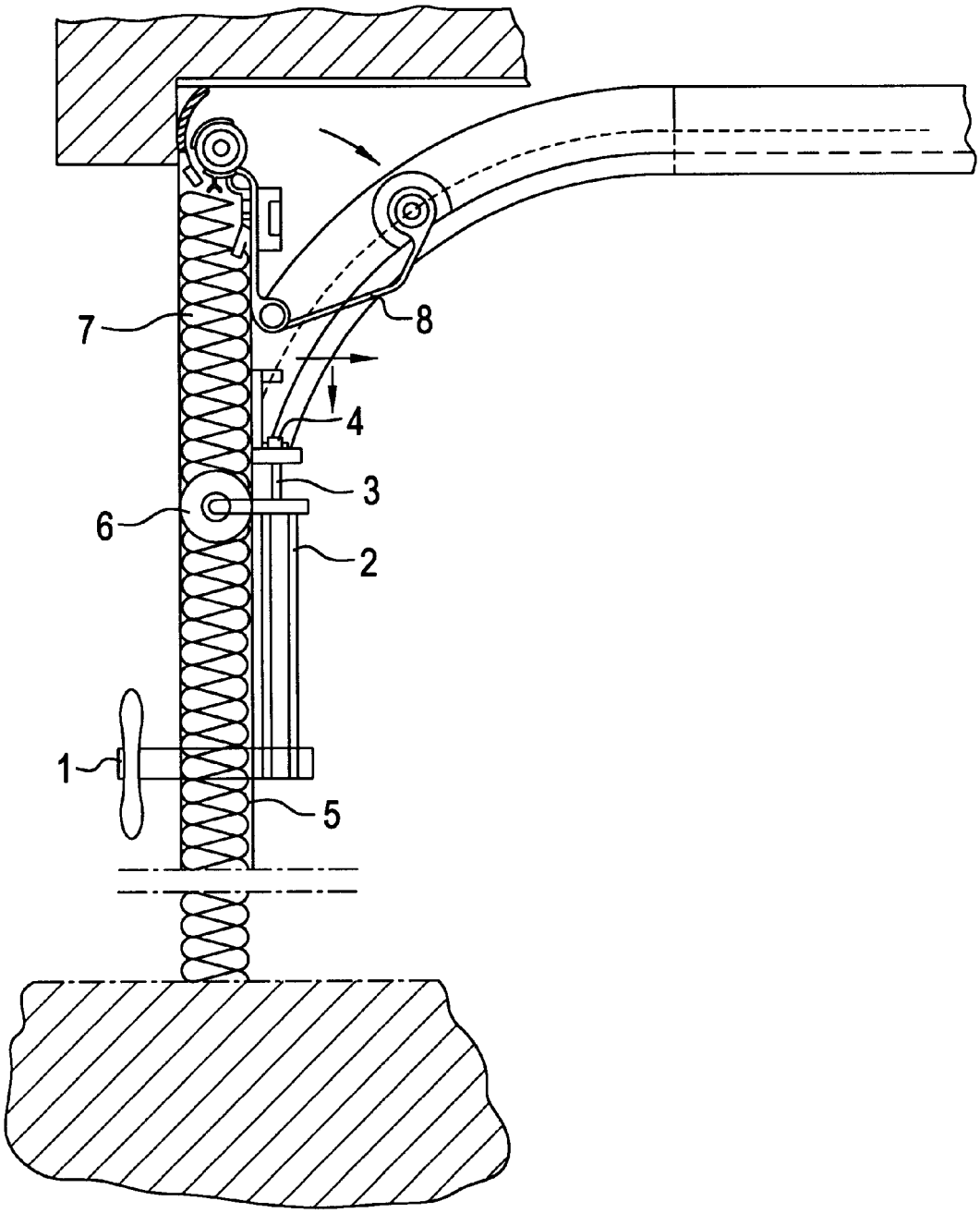
FIG. 7. shows an alternative design for opening and closing the gate by use of a manual handle.

In accordance with a further design form according to FIG. 7, the handle 101 is manually turned and the side rod, or the shifting element 103, which is guided into the flexible guide 102, is thereby drawn downwards. A turning moment arises because of the pulling force acting on the lever 104, and the upper section 107 tilts backwards into the runner, so the gate can be pushed up. When being moved down, a turning movement of the handle 101 once again takes place in the reverse direction after the gate has been completely pushed into the lower end position, so that the side rod 103, the lever 104, and consequently the section 107, which is supported in the joint 106, are pushed into the vertical position.

What is claimed is:

1. A sectional gate assembly having an open position and a closed position comprising:

a gate;

an upper closing element and a lower closing element for closing up a gate assembly opening, said upper closing element being flexibly connected with said lower closing element, each said closing element having a first and a second opposite side and each having at least one guide arranged on each of said first and second opposite sides of said each said closing element, said lower closing element connected to said gate assembly at least closely adjacent to said first opposite side;

a first and a second single track guide rail, said at least one guide adapted to move within said guide rail, said first and second guide rails each having a vertical section and a horizontal section connected with a curved portion;

a weight-counterbalancer having a traction mechanism which engages at a first end on one of said closing elements, and at a second end on an energy accumulator allowing said lower closing element to move into said horizontal section;

said weight-counterbalancer including a deflection roller for said traction mechanism arranged beneath said horizontal section so that said weight-counterbalancer exerts, by way of said traction mechanism a pulling force that acts generally horizontally on said lower closing element in said gate assembly open position, said pulling force acting generally vertically on said lower closing element in said gate assembly closed position; and means for swiveling an upper edge of said upper closing element out of alignment with said guide rails in said closed position including a pivoting lever attached to said upper closing element and having means for driving said upper closing element from a first position in said gate assembly open position into a second position in said gate assembly closed position and back to said first position.

2. The sectional gate assembly of claim 1, wherein said weight-counterbalancing mechanism is located adjacent, outside, and under said horizontal section and said curved portion of said guide rail.

3. The sectional gate assembly of claim 1, wherein said weight-counterbalancer has second deflection roller means for guiding said traction mechanism which is generally parallel to said vertical section.

4. The sectional gate assembly of claim 1, wherein said weight-counterbalancer is covered by a housing which includes an opening for said traction mechanism to pass through.

5. The sectional gate assembly of claim 1, including an adjustable limit stop for holding down said closing elements against a restoring force of said weight-counterbalancer in said gate assembly closed position.

6. The sectional gate assembly of claim 1, wherein said pivoting lever is rotatably connected at a first end to an upper guidance mechanism which is attached to said upper closing element and is rotatably connected at a second end to said upper closing element at a distance spaced from said upper edge of said closing element, said rotatable connections forming swivel axes that allow said upper closing element to swivel upwards in said gate assembly closed position, whereby said gate assembly opening is closed.

7. The section gate assembly of claim 1, wherein said pivoting lever is actuated by two pairs of guide rollers, one said pair arranged on said first opposite side, the other said pair arranged on said second opposite side.

8. The section gate assembly of claim 1, including a side rod drive which engages at an upper end area of said upper closing element and acts generally parallel to said horizontal section.

9. A sectional gate assembly having an open position and a closed position comprising:

a gate;

an upper closing element and a lower closing element for closing up a gate assembly opening, said upper closing element being flexibly connected with said lower closing element, each said closing element having a first and a second opposite side and each having at least one guide arranged on each of said first and second opposite sides of said each said closing element, said lower closing element connected to said gate at least closely adjacent to said first opposite side;

a first and a second single track guide rail, said at least one guide adapted to move within said guide rail, said first and second guide rails each having a vertical section and a horizontal section connected with a curved portion;

a weight-counterbalancer having a traction mechanism which engages at a first end on one of said closing elements, and at a second end on an energy accumulator allowing said lower closing element to move into said horizontal section, said weight-counterbalancer having a coupler whereby said traction mechanism engages at one end on a catch piece having means for coupling and decoupling and at the other end on said energy accumulator;

a carrier which is decoupled with said catch piece when said closing elements are in an open position corresponding to said guide elements being in said horizontal section and is coupled with said catch piece in a closed position corresponding to said guide elements being in said vertical section; and means for swiveling an upper edge of said upper closing element out of alignment with said guide rails in said closed position including a pivoting lever attached to said upper closing element and having means for driving said upper closing element from a first position in said gate assembly open position into a second position in said gate assembly closed position and back to said first position.

10. The sectional gate assembly of claim, 9, wherein said weight-counterbalancing mechanism is located adjacent, outside, and under said horizontal section and said curved portion of said guide rail.

11. The sectional gate assembly of claim 9, wherein said weight-counterbalancer has second deflection roller means for guiding said traction mechanism which is generally parallel to said vertical section.

12. The sectional gate assembly of claim 9, wherein said weight-counterbalancer is covered by a housing which includes an opening for said traction mechanism to pass through.

13. The sectional gate assembly of claim 9, including an adjustable limit stop for holding down said closing elements against a restoring force of said weight-counterbalancer in said gate assembly closed position.

14. The sectional gate assembly of claim 9, wherein said pivoting lever is rotatably connected at a first end to an upper guidance mechanism which is attached to said upper closing element and is rotatably connected at a second end to said upper closing element at a distance spaced from said upper edge of said closing element, said rotatable connections forming swivel axes that allow said upper closing element to swivel upwards in said gate assembly closed position, whereby said gate assembly opening is closed.

15. The section gate assembly of claim 9, wherein said pivoting lever is actuated by two pairs of guide rollers, one said pair arranged on said first opposite side, the other said pair arranged on said second opposite side.

16. The section gate assembly of claim 9, including a side rod drive which engages at an upper end area of said upper closing element and acts generally parallel to said horizontal section.

17. A sectional gate assembly having an open position and a closed position comprising:

a gate;

an upper closing element and a lower closing element for closing up a gate assembly opening, said upper closing element being flexibly connected with said lower closing element, each said closing element having a first and a second opposite side and each having at least one guide arranged on each of said first and second opposite sides of said each said closing element, said lower closing element connected to said gate assembly at least closely adjacent to said first opposite side;

a first and a second single track guide rail, said at least one guide adapted to move within said guide rail, said first and second guide rails each having a vertical section and a horizontal section connected with a curved portion;

a weight-counterbalancer having a traction mechanism which engages at a first end on one of said closing elements, and at a second end on an energy accumulator allowing said lower closing element to move into said horizontal section; and means for swiveling an upper edge of said upper closing element out of alignment with said guide rails into a position generally aligned with said vertical section of said first and second guide rails in said gate assembly closed position.

18. The sectional gate assembly of claim 17, wherein said means for swiveling includes a pivot lever.

19. The sectional gate assembly of claim 17, wherein said means for swiveling includes a pivot lever having a first portion attached to said upper closing element and a second portion attached to at least one guide roller which moves in said first and second guide rails.

* * * * *